United States Patent [19]

Waldau

[11] 4,182,461

[45] Jan. 8, 1980

[54] CLOSURE ARRANGEMENT FOR CONTAINER

[76] Inventor: Karl O. Waldau, Hagvägen 20, 722 33 Västerås, Sweden

[21] Appl. No.: 925,759

[22] Filed: Jul. 18, 1978

[30] Foreign Application Priority Data

Jul. 19, 1977 [SE] Sweden ..... 7708333
Oct. 11, 1977 [SE] Sweden ..... 7711438

[51] Int. Cl.[2] ..... B65D 45/32
[52] U.S. Cl. ..... 220/320; 215/279
[58] Field of Search ..... 220/319, 320, 378; 215/274, 279; 292/256.65, 246.6, 256.61

[56] References Cited

U.S. PATENT DOCUMENTS

| | | | |
|---|---|---|---|
| 1,713,224 | 5/1929 | Gunter | 220/319 X |
| 2,031,531 | 2/1936 | Fiese | 215/279 |
| 2,108,944 | 2/1938 | Rheem | 220/320 X |

*Primary Examiner*—George T. Hall
*Attorney, Agent, or Firm*—Fleit & Jacobson

[57] ABSTRACT

An arrangement for closing an open end of a substantially stiff, generally cylindrical side wall of a container is disclosed, comprising a cover of an elastic, resilient material to be fixed to an end portion of the side wall. Said cover includes a central main portion forming an end wall of the container and an integral peripheral flange projecting in an axially outward direction from said main portion. A hard spring, formed by a ring of circumferentially closed configuration, is pressed into the cover, on the inner side of said flange, and into engagement with a selected circumferentially extending section of the flange to force the outer side of said flange section into contact under pressure with the inner side of the end portion of the side wall. Hereby a tight connection is established between the cover and the side wall and the cover is firmly fixed to the side wall.

7 Claims, 3 Drawing Figures

CLOSURE ARRANGEMENT FOR CONTAINER

Figure 1:
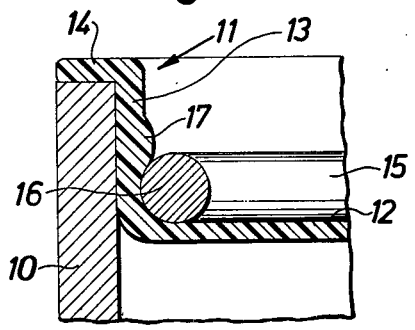

The present invention relates to an arrangement for closing an open end of a substantially stiff, circumferentially closed side wall of a container, such as a generally cylindrical drum. More particularly, the invention relates to such an arrangement of the kind comprising a cover of an elastic, resilient material, which is adapted to be fixed to an end portion of the side wall and which includes a central main portion adapted to form an end wall of the container and a peripheral flange formed integrally with the main portion and projecting in a generally axially outward direction from the main portion of the cover, said flange being insertable a limited length into said end portion of the side wall together with the main portion of the cover and adapted to be brought with its outer side into sealing contact with the inner side of the end portion of the side wall.

The invention is especially intended to be utilized in connection with containers having a side wall, or body, consisting of a plurality of paper layers wound upon each other and secured together by means of any suitable adhesive. However, the invention is not restricted to containers having such a side wall. Instead, it may be utilized also in conjunction with containers having a body, or side wall, consisting of any suitable other material, such as plastics or sheet metal.

It has previously been proposed to provide the required interlocking between the cover and the side wall of the container and the desired sealed connection between the flange of the cover and the side wall by welding, glueing or riveting. Also screw joints have been utilized for said object. However, in practice, said methods have been found unsatisfactory, as leakage may easily occur in the joint between the flange of the cover and the side wall if the container is subjected to heavy shocks or impacts. Another manifest disadvantage of the methods previously used for connecting the cover to the side wall of the container is that they are time-consuming and complicated to carry out. Furthermore, they have also made it impossible to remove the cover from the side wall in a fast and expedient manner.

An object of the invention is to provide an improved arrangement of the kind initially specified which avoids the disadvantages above mentioned and makes it possible to secure the cover to the side wall in a quick and easy fashion, to maintain an appropriate sealing between the cover and the side wall even if the container is subjected to considerable impacts or shocks, and to remove the cover from the side wall in an easy and rapid way. For this purpose, the invention provides an arrangement of the kind initially specified, characterized by a closed hard spring ring which is adapted to be pressed into the cover, on the inner side of the flange of the cover, into engagement with a selected circumferentially extending section of the flange to force the outer side of said flange section into contact under pressure with the inner side of the end portion of the side wall.

According to a preferred embodiment of the invention, the arrangement may include means for holding the spring ring in engagement with said selected portion of the flange of the cover. Said holding means may consist of a shoulder formed by an integral portion of the flange of the cover projecting from the inner side of said flange. Alternatively, the holding means may be formed by a separate holding member which is adapted to be removably attached to the inner side of the flange of the cover. Said separate holding member may advantageously consist of a resilient flexible open-ended locking ring which is adapted to engage in a circumferentially extending recess on the inner side of said flange.

In order to reduce the risk of an unintentional separation of the cover from the side wall of the container as a consequence of any axial forces acting on the cover, the arrangement may preferably also be provided with an annular interlocking member for providing an improved interconnection between the side wall and the cover through engagement with the flange of the cover and the end portion of the side wall. Said interlocking member may suitably be arranged to engage the flange of the cover at a position located at some axial distance from said selected portion of the flange towards the free end of the flange.

Figure 2:
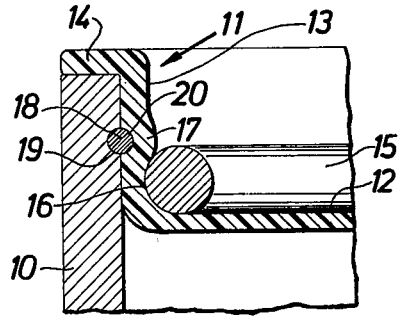
Figure 3:
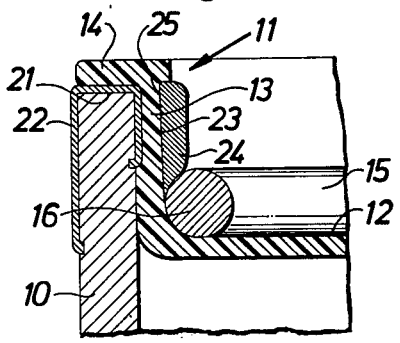

Below the invention will be described in further detail, reference being had, by way of example, to the accompanying diagrammatic drawing in which:

FIG. 1 shows a partial sectional view of a drum-like container comprising a generally cylindrical side wall, or body, and an arrangement according to a first embodiment of the invention for closing an open end of said side wall, while FIGS. 2 and 3 show corresponding partial sectional views, illustrating two further alternative embodiments of the invention.

In FIG. 1 reference numeral 10 designates a substantially stiff, generally cylindrical side wall, or body, of a drum-like container. At its upper end, shown in the drawing, the side wall 10 is closed by means of a cover 11 secured to the side wall 10 in a manner to be described below. A similar cover may be provided at the other end of side wall 10. The side wall 10 may consist of any suitable material, such as paper, cardboard, plastics, sheet metal of any combination of said materials. However, as already mentioned, the invention is especially intended to be utilized in conjunction with containers having a side wall formed by several layers of paper wound upon each other and secured together by means of a suitable adhesive to form a side wall having a high stiffness. The cover 11 should consist of an elastic, resilient material, preferably of an elastic, resilient plastics. The cover may for instance consist of polyprophene, polyvinylchloride, or any other suitable thermoplastics.

The cover 11 comprises a central main portion 12 serving as an end wall of the container and provided around its periphery with a generally axially projecting flange 13, at its outer free end terminating into an end flange 14 extending in radial ourward direction. The axially extending flange 13 is intended, upon mounting cover 11 on side wall 10, to be brought with its outer side into sealing contact with the inner side of the side wall. The radially extending end flange 14 forms an abutment, cooperating with the end surface of side wall 10 to restrict the axial length along which the cover may be inserted into the side wall.

In FIG. 1 reference numeral 15 designates a circumferentially closed ring of spring steel or any other suitable material forming a hard spring. The spring ring 15 is intended to cause an appropriate sealing between cover 11 and side wall 10 and to hold the cover firmly in position in the end portion of the side wall. In order to provide this function, the spring ring 15 may be pressed into the cover 11 on the inner side of flange 13 and into engagement with a selected circumferentially extending section 16 of flange 13 located at the transition between flange 13 and main portion 12 and having such inner and outer diameters as to ensure that section 16 will be forced laterally outwardly by ring 15 into contact under pressure with the inner side of side wall 10. On its inner side flange 13 is provided with a circumferentially extending bulge, located immediately outside section 16 in an axial direction to form a shoulder adapted to cooperate with spring ring 15 to maintain said ring in engagement with flange section 16.

In FIGS. 2 and 3 elements corresponding to those shown in FIG. 1 have been designated by the same reference numerals as used in FIG. 1.

The embodiment shown in FIG. 2 differs from the embodiment of FIG. 1 only in that a ring 18 has been provided as an interlocking member between side wall 10 and flange 13 of cover 11 to provide an improved interengagement between the cover and the side wall. Said ring 18 is arranged to be partially received on the one hand in a circumferantial groove 19 in side wall 11, on the inner side of said wall, and on the other hand in a circumferential groove 20 in flange 13, on the outer side of said flange. Through its engagement in grooves 19 and 20, ring 18 will efficiently oppose any release of cover 11 from side wall 10 upon the occurance of any axial forces acting on the cover. As shown in FIG. 2, the interlocking ring 18 may suitably be positioned at some axial distance from spring ring 15 towards the free end of flange 13.

In the embodiment shown in FIG. 3, the interlocking ring 18 of FIG. 2 has been replaced by a ferrule 21 of generally U-shaped cross-section mounted on the end of side wall 10. Ferrule 21, which suitably may consist of sheet metal, has an outer leg 22 extending on the outer side of side wall 10 and an inner leg 23 extending a limited length along the inner side of said wall to form an interlocking means adapted to provide an improved interconnection between the cover and the side wall of the container.

The ferrule 21 is firmly anchored to side wall 10 by means of the free end portions of its two legs 22 and 23 which are bent into the side wall.

The arrangement according to FIG. 3 differs from the two embodiments previously discussed also in that the bulge 17 on the inner side of flange 13 has been replaced by a separate holding member 24 which is adapted to be removably mounted on the inner side of flange 13 to maintain spring ring 15 in its desired position in engagement with section 16. Said separate holding member 24 is formed by an open-ended resiliently flexible locking ring, the upper end of which is partially received in a recess 25 in flange 13, while the lower end contacts spring ring 15 to maintain the same inengagement with flange section 16. Said locking ring 24 may suitably consist of comparatively stiff plastics, for instance a suitable polyvinylchloride, or of metal.

In all three embodiments shown in the drawing, flange 13 of cover 11 has been shown to have a generally flat outer side. In practice, however, flange 13 may be provided with a number of circumferentially extending low ridges on its outer side. Hereby a corresponding number of peripheral zones of very high contact pressure may be obtained between the flange of the cover and the side wall 10 causing an improved sealing between the cover and the side wall. If said ridges have a suitable profile, they may also contribute to maintain the cover in position in the end portion of the side wall.

When the cover 11 is to be mounted on side wall 10, it is inserted into the end portion of the side wall, whereupon spring ring 15 is pressed into the cover into engagement with flange section 16. The application of spring ring 15 may be facilitated if, to start with, this ring is inserted partially in the cover in an inclined position so that a short peripheral portion thereof will rest against the main portion 12 of the cover adjacent to flange 13, while an opposite peripheral portion will rest against the upper end of flange 13. Hereupon the ring 15 is pressed completely into the cover by means of a suitable tool applied against the last-mentioned raised portion of said ring.

The cover 11 may easily be removed from the side wall 10 by firstly removing spring ring 15. In order to facilitate the removal of the spring ring 15 from the cover, said ring may be provided with a number of projections against which a suitable tool may be applied to permit a first peripheral portion of the ring to be lifted up from the cover for subsequent removal of the whole ring. Alternatively, the spring ring may have such a cross-section as to form a continuous application surface for a lifting tool along its whole length.

The invention is not restricted to the embodiments above described and shown in the drawing. Thus, said embodiments may be modified in various manners within the scope of the invention. Especially, it should be noted that the spring ring does not need to have a solid cross-section, as shown in the drawing. Instead, it may be hollow or have any other suitable cross-section. Furthermore, the flange of the cover may have many other shapes than those shown in the drawing. If desired, a thin foil, for instance of aluminum, may be placed on the inner side of the cover to protect the cover against influence from the contents of the container. Hereby it is possible to avoid the need of making the cover from a material resistant against such contents. If the stiffness of the side wall is considered insufficient to resist the forces caused by spring ring 15, the side wall 10 may be reinforced, for instance by means of a closed ring of metal or other suitable material pressed onto the side wall on the outer side thereof.

Finally, it should be mentioned that the self-locking function of the arrangement according to the invention, provided by the spring ring, makes it possible, when the container has been opened, to reclose it, if so desired.

What I claim is:

1. An arrangement for closing an open end of a substantially stiff, circumferentially closed side wall of a container, such as a generally cylindrical drum, said arrangement comprising a cover of an elastic, resilient material which is adapted to be fixed to an end portion of the side wall and which includes a central main portion adapted to form an end wall of the container and a peripheral flange formed integrally with the main portion and projecting in a generally axially outward direction from the main portion of the cover, said flange being insertable a limited length into said portion of the side wall together with the main portion of the cover in order to be brought with its outer side into sealing contact with the inner side of the end portion of the side wall, further comprising a hard circumferential spring ring that is closed about its entire circumference and which is adapted to be pressed into the cover, on the inner side of said flange, into engagement with a selected circumferentially extending section of the flange to force the outer side of said flange section into contact under pressure with the inner side of said end portion of the side wall.

2. An arrangement according to claim 1, characterized by holding means for holding the spring ring in engagement with the selected portion of the flange of the cover.

3. An arrangement according to claim 2, wherein said holding means comprises a shoulder formed by an integral portion of the flange of the cover projecting from the inner side of said flange.

4. An arrangement for closing an open end of a substantially stiff, circumferentially closed side wall of a container, such as a generally cylindrical drum, said arrangement comprising a cover of an elastic, resilient material which is adapted to be fixed to an end portion of the side wall and which includes a central main portion adapted to form an end wall of the container and a peripheral flange formed integrally with the main portion and projecting in a generally axially outward direction from the main portion of the cover, said flange being insertable a limited length into said end portion of the side wall together with the main portion of the cover in order to be brought with its outer side into sealing contact with the inner side of the end portion of the side wall, a closed hard spring ring which is adapted to be pressed into the cover, on the inner side of said flange, into engagement with a selected circumferentially extending section of the flange to force the outer side of said flange section into contact under pressure with the inner side of said end portion of the side wall and holding means for holding the spring ring in engagement with the selected portion of the flange of the cover, said holding means comprising a separate holding member which is adapted to be removably attached to the inner side of the flange of the cover.

5. An arrangement according to claim 4, further comprising a separate second holding member comprising a resiliently flexible open-ended locking ring adapted to engage in a circumferentially extending recess on the inner side of the flange.

6. An arrangement according to claims 1 or 4, characterized by an annular interlocking member for providing a further interconnection between the side wall and the cover through engagement with the flange of the cover and the end portion of the side wall.

7. An arrangement according to claim 6, characterized in that the interlocking member is arranged to engage the flange of the cover at a position located at some axial distance from said selected portion of the flange towards the free end of the flange.

* * * * *